US007439680B2

(12) United States Patent
Gao et al.

(10) Patent No.: US 7,439,680 B2
(45) Date of Patent: Oct. 21, 2008

(54) APPARATUS FOR SAFELY CONNECTING THE LAMP TO THE EQUIPMENT VOLTAGE GROUND

(75) Inventors: Ange Gao, Guangdong (CN); Rene Twardzik, Traunreut (DE)

(73) Assignee: Patent-Treuhand-Gesellschaft für Elektrische Glühlampen mbH, München (DE)

( * ) Notice: Subject to any disclaimer, the term of this patent is extended or adjusted under 35 U.S.C. 154(b) by 0 days.

(21) Appl. No.: 11/441,006

(22) Filed: May 26, 2006

(65) Prior Publication Data

US 2006/0267519 A1 Nov. 30, 2006

(30) Foreign Application Priority Data

May 31, 2005 (CN) ..... 2005 1 0074100

(51) Int. Cl.
*H05B 37/00* (2006.01)

(52) U.S. Cl. ..... 315/209 R; 315/224

(58) Field of Classification Search ..... 315/224–225, 315/291, 307, 125–126, DIG. 2, DIG. 4, 315/DIG. 5, DIG. 7, 4, 216, 128, 209 R, 299; 362/20–21, 34
See application file for complete search history.

(56) References Cited

U.S. PATENT DOCUMENTS 4,398,126 A 8/1983 Zuchtriegel
4,943,886 A 7/1990 Quazi
5,444,333 A * 8/1995 Lau ..... 315/94
5,869,935 A * 2/1999 Sodhi ..... 315/225
5,869,937 A * 2/1999 Konopka ..... 315/291
6,291,944 B1 * 9/2001 Hesterman et al. ..... 315/224
6,566,822 B2 * 5/2003 Schadhauser et al. ..... 315/224
6,696,791 B2 * 2/2004 Raiser et al. ..... 315/94
6,936,973 B2 * 8/2005 Parra et al. ..... 315/209 R
2002/0047604 A1 4/2002 Schadhauser et al.
2004/0124785 A1 * 7/2004 Alexandrov ..... 315/291

* cited by examiner

*Primary Examiner*—Douglas W. Owens
*Assistant Examiner*—Minh Dieu A
(74) *Attorney, Agent, or Firm*—Carlo S. Bessone

(57) ABSTRACT

Apparatus for safely connecting a lamp to an equipment voltage ground, includes a rectification circuit for rectifying the power supply alternating voltage into a direct voltage, and an oscillating circuit for converting the direct voltage into alternating voltage for driving the lamp to work. The oscillating circuit includes a DC-blocking capacitor, a oscillating inductor and an oscillating capacitor orderly connected in series, and one end of the DC-blocking capacitor is connected to the output rectification voltage of the rectification circuit, and another end is connected to the oscillating inductor, while one end of the oscillating capacitor is connected to the equipment voltage ground, and another end is connected to the working voltage terminal of the lamp. The ground terminal of the lamp is electrically connected to the equipment voltage ground through a parallel circuit formed of a switch and a high impedance capacitor.

11 Claims, 2 Drawing Sheets

APPARATUS FOR SAFELY CONNECTING THE LAMP TO THE EQUIPMENT VOLTAGE GROUND

TECHNICAL FIELD

The present invention relates to an apparatus for safely connecting the lamp to the equipment voltage ground (EVG), which comprises a rectification circuit for rectifying the power supply alternating voltage into a direct voltage, and an oscillating circuit for converting said direct voltage into alternating voltage for driving the lamp to work, wherein said oscillating circuit comprises the DC-blocking capacitor, the oscillating inductor and the oscillating capacitor orderly connected in series, and one end of said DC-blocking capacitor is connected to the output rectification voltage of said rectification circuit, and another end thereof is connected to said oscillating inductor, while one end of said oscillating capacitor is connected to the equipment voltage ground, and another end thereof is connected to the working voltage terminal of the lamp.

BACKGROUND ART

In the prior art, due to the inconsistency between the equipment voltage ground (EVG) in the lamp circuit apparatus and the actual grounding, there might be dangerous voltage on the lamp or there might be phenomena of damage to the lamp circuit.

In the case of detecting the end of lamp life, it is very advantageous to directly connect a terminal of the lamp to the equipment voltage ground (EVG), because in this way, the voltage on the lamp to be detected will no longer contain a half value of the DC component of the rectified voltage of the rectification circuit. However, on the other hand, such kind of circuit has a big problem, because when the internal equipment voltage ground (EVG) contacts the external ground terminal, the lamp might be ignited, and this may be one of the following case, i.e., only one terminal of the lamp is connected (e.g., during maintenance) while another terminal thereof is contacted by a person, as shown in FIG. 1. In the known lamp circuit apparatus as shown in FIG. 1, the circuit forms a closed loop via the voltage source, external ground, human body, lamp, internal ground EVG, diode D4 and filtering circuit C1, C6.

In addition, when the lead of the EVG towards the lamp contacts the external ground, there might be the danger of damaging the lamp circuit apparatus despite if the lamp is connected to the lamp circuit apparatus or not, as shown in FIG. 2.

For the above reasons, such lamp circuit apparatus in the European market has the above-mentioned danger hiding behind, while in the U.S., such lamp circuit apparatus is not employed due to the high mains voltage.

CONTENTS OF THE INVENTION

The technical problem to be solved by the present invention is to provide lamp circuit apparatus for safely connecting the lamp to the equipment voltage ground EVG, such that the above-mentioned hidden danger could be removed when the lamp is directly connected to the internal equipment voltage ground EVG.

The lamp circuit apparatus for safely connecting the lamp to the equipment voltage ground according to the present invention comprises a rectification circuit for rectifying the power supply alternating voltage into a direct voltage, and an oscillating circuit for converting said direct voltage into the alternating voltage for driving the lamp to work, wherein said oscillating circuit comprises the DC-blocking capacitor, the oscillating inductor and the oscillating capacitor orderly connected in series, and one end of said DC-blocking capacitor is connected to the output rectification voltage of said rectification circuit, and another end thereof is connected to said oscillating inductor, while one end of said oscillating capacitor is connected to the equipment voltage ground, and another end thereof is connected to the working voltage terminal of the lamp, and wherein the ground terminal of the lamp is electrically connected to the equipment voltage ground through a parallel circuit formed of a switch and a high impedance capacitor, wherein said switch is controlled by the control circuit provided within said apparatus to be closed only after the lamp is normally ignited, and to keep open under other states. By means of this solution, the present invention prevents people from the danger of getting an electric shock and prevents the lamp circuit apparatus from being damaged.

Preferably, the terminal of said oscillating capacitor which is connected to the equipment voltage ground is electrically connected, together with the ground terminal of the lamp, to the equipment voltage ground through said parallel circuit.

More preferably, a primary pre-heating coil is connected between said oscillating capacitor and said high impedance capacitor, and that a secondary pre-heating coil is respectively connected to both terminals of the lamp, so that said secondary pre-heating coil pre-heats the filament by using the voltage sensed from the primary pre-heating coil. Thus while achieving the above-mentioned technical effect, the filament is pre-heated.

According to a further improved solution, the output voltage of said rectification circuit is connected to the input terminal of said DC-blocking capacitor through the first control switch, then is connected to the equipment voltage ground through the second control switch, such that said oscillating circuit charges by means of the direct voltage through said first control switch and discharges towards the equipment voltage ground through said second control switch.

Preferably, said first and second control switch are automatically controlled by said control circuit, so that said oscillating circuit oscillates according to the normal working current of the lamp.

Advantageously, the output voltage of said rectification circuit is smoothed by means of a downstream-connected filtering capacitor.

Said DC-blocking capacitor could preferably be 100 times of said oscillating capacitor.

Alternatively, said rectification circuit is formed of a half-bridge consisting of four diodes.

Moreover, the power supply voltage could be connected to said half bridge through a de-interfering capacitor connected in parallel with said power supply voltage so as to filter interference voltage.

Besides, a protective fuse could be connected between said de-interfering capacitor and the power supply.

The power supply voltage could be connected in parallel to another de-interfering capacitor between said protective fuse and power supply.

DESCRIPTION OF FIGURES

The embodiments of the present invention will be described in detail hereinafter in connection with the figures, wherein.

SPECIFIC EMBODIMENTS

Figure 1:
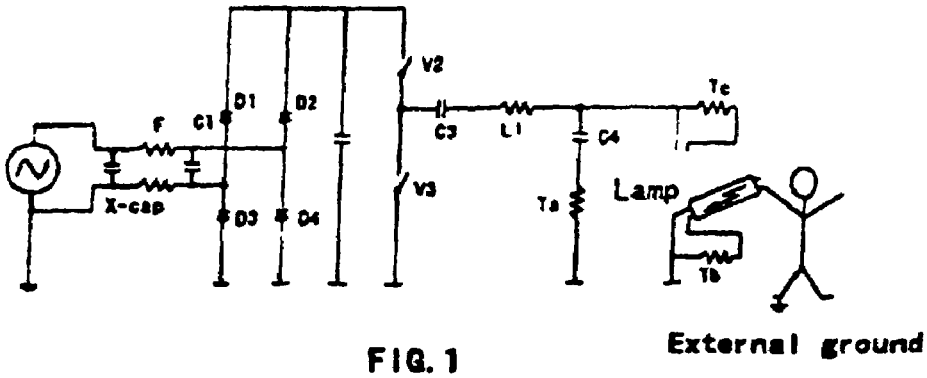
FIG. 1 PRIOR ART
FIG. 1 shows the situations of danger to people that might appear in the prior art lamp circuit apparatus.
Figure 2:
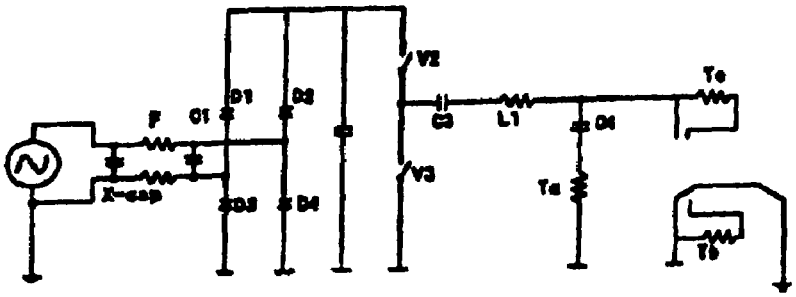
FIG. 2 PRIOR ART
FIG. 2 shows the situations of damage to the apparatus that might appear in the prior art lamp circuit apparatus.
Figure 3:
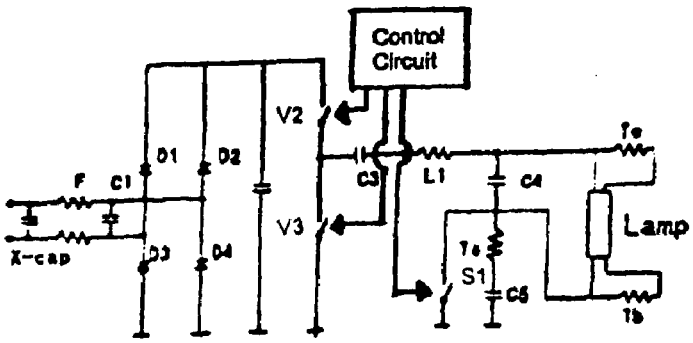
FIG. 3 shows an embodiment of the lamp circuit apparatus of the present invention.

The prior art as shown in FIG. 1 and FIG. 2 has been illustrated in the part of background art previously, now reference will be made to the embodiment of the lamp circuit apparatus of the present invention as shown in FIG. 3.

The lamp circuit apparatus as shown in FIG. 3 comprises a rectification circuit formed of a half bridge consisting of four diodes D1-D4, which is used for rectifying the supplied power supply alternating voltage into a direct voltage. In addition, there is an oscillator circuit formed of a DC-blocking capacitor C3, an oscillator inductor L1 and an oscillating capacitor C4, which is used for converting said direct voltage into alternating voltage for driving the lamp to work. One end of said DC-blocking capacitor C3 is connected to the output rectification voltage of said rectification circuit, and another end thereof is connected to said oscillating inductor L1, while one end of said oscillating capacitor C4 is connected to the equipment voltage ground EVG, and another end thereof is connected to the working voltage terminal of the lamp. The ground terminal of the lamp is electrically connected to the equipment voltage ground EVG through a parallel circuit formed of a switch S1 and a high impedance capacitor C5, wherein said switch S1 is controlled by the control circuit provided within said apparatus to be closed only after the lamp is normally ignited, and to keep open under other states.

By comparing FIG. 3 with the prior art FIGS. 1 and 2, it can be seen that this embodiment of the present invention differs by adding a parallel circuit formed of a switch S1 and a series circuit including a high impedance capacitor C5 and a primary pre-heating coil Ta. The primary pre-heating coil Ta is used in cooperation with the secondary pre-heating coils provided at the two terminals of the lamp, so that the secondary pre-heating coils Tb, Tc pre-heat the filaments by inducing the current from the primary pre-heating coil Ta when the lamp is started. Obviously, the primary pre-heating coil Ta could also be provided, for example, between the oscillating inductor L1 and the oscillating capacitor C4, or between the DC-blocking capacitor C3 and the second switch V3, but it is not limited to the situation shown in FIG. 3, and these designs could also achieve the effect of pre-heating the filament.

In addition, in the embodiment shown in FIG. 3, said oscillating capacitor C4 could also be directly electrically connected to the equipment voltage ground EVG. The rectified voltage is smoothed by the downstream-connected filtering capacitor C2. The output voltage of said rectification circuit is connected to the input terminal of said DC-blocking capacitor C3 through the first control switch V2, then it is connected to the equipment voltage ground EVG through the second control switch V3, such that said oscillating circuit charges by means of the DC voltage through said first control switch and discharges towards the equipment voltage ground EVG through said second control switch V3. The DC-blocking capacitor C3 could be 100 times of said oscillating capacitor C4. Said first and second control switch V2 and V3 are automatically controlled by said control circuit, so that said oscillating circuit oscillates according to the normal working current of the lamp.

It can be seen from the figure that the power supply voltage is connected to said half bridge through a de-interfering capacitor C1 connected in parallel with said power supply voltage so as to filter interference voltage. There is a protective fuse F between said de-interfering capacitor C1 and the power supply. The power supply voltage is connected in parallel to another de-interfering capacitor C6 between said protective fuse F and power supply.

The working principle and process of said lamp circuit apparatus will be illustrated in the following.

During the pre-heating process of the apparatus as shown in FIG. 3, electric current flows through a resonance loop consisting of the DC-blocking capacitor C3, the oscillating inductor L1, the oscillating capacitor C4, the primary pre-heating coil Ta and the high impedance capacitor C5, thereby to sense electric current in the secondary pre-heating coils Ta, Tc to supply to the filament for pre-heating. In this while, the switch S1 is controlled to be in the state of open by the present control circuit already in said lamp circuit apparatus.

After the pre-heating process, the frequency of the oscillating circuit is lowered by the control of said control circuit. Thus, according to resonance, the voltage across the lamp (i.e., the voltage across the two terminals of C4) reaches a voltage value that is high enough to ignite the lamp. Therefore, the lamp is ignited and the electric current passes the DC-blocking capacitor C3, the oscillating inductor L1 and flows through the lamp connected in parallel to the oscillating capacitor C4 and the primary pre-heating coil Ta.

After ignition, the switch S1 which is connected in parallel to the primary pre-heating coil Ta and the high impedance capacitor C5 is controlled by said control circuit at this time to be in a closed state so as to end the pre-heating.

With respect to the possible cases of failures, the lamp circuit apparatus of the present invention functions in the following process:

1) In the case that one terminal of the lamp is connected to the lamp circuit apparatus.

Figure 4:
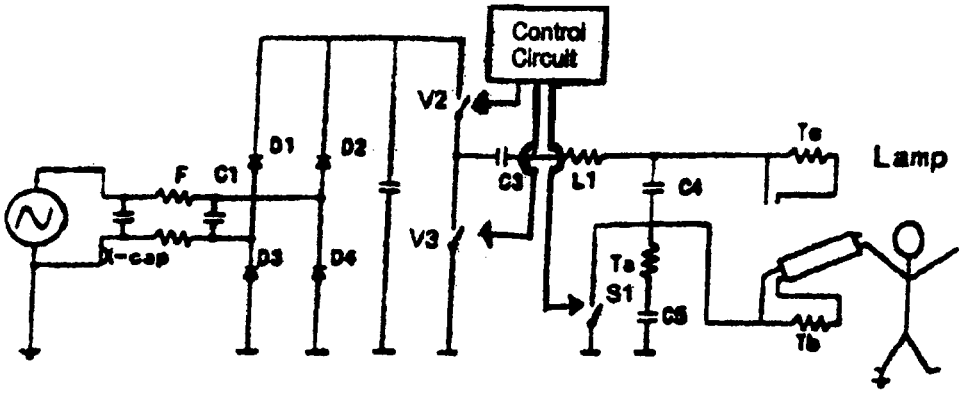
FIG. 4 shows the situation of removing the danger to people in the lamp circuit apparatus of the present invention.

Reference could be made to FIG. 4 in this regard. The filament is connected to the cold end of the lamp circuit apparatus (i.e., it is connected to the terminal of the equipment voltage ground EVG). The lamp circuit apparatus starts to operate, that is, it only starts to work when it is detected that filament is electrically connected to the cold end of said lamp circuit apparatus. Said detection could be done by said control circuit. Then the whole pre-heating and ignition process is performed. However, due to a failure in ignition (because another terminal of the lamp is not electrically connected to said lamp circuit apparatus, and this could also be detected by said circuit control apparatus), the whole half bridge circuit is disconnected by the switch V2, while the switch S1 had not been previously activated, i.e., it had not been closed. Therefore, the ground terminal of the lamp is disconnected with the equipment voltage ground EVG through the high impedance capacitor C5. Said high impedance capacitor C5 has high impedance on, for example, the mains voltage of 50 Hz, so that there will not be dangerous voltage on the ground terminal of the lamp.

2) In the case that the lamp is not electrically connected to the lamp circuit apparatus.

Figure 5:
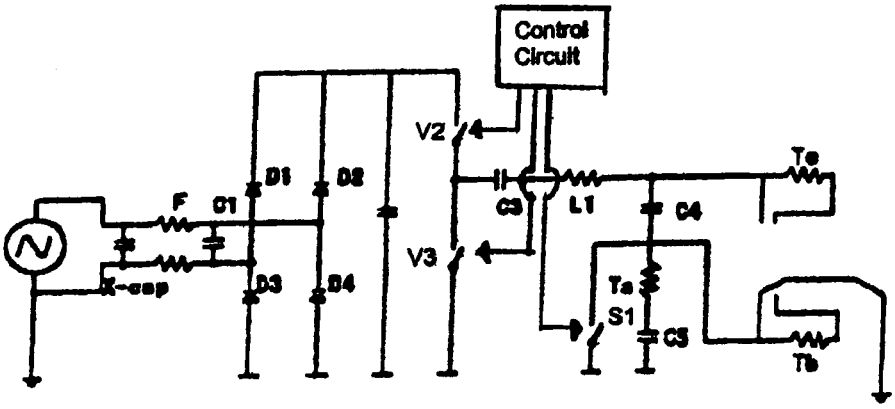
FIG. 5 shows the situation of removing damage to the apparatus in the lamp circuit apparatus of the present invention.

Reference could be made to FIG. 5 in this regard. Suppose that the ground terminal of the lamp is mistakenly connected to the external ground. Through monitoring the filament by, for example, the present control circuit, the lamp circuit apparatus will not be started, and the switch S1 between the internal equipment voltage ground EVG and the ground terminal of the lamp will be kept open. Therefore, there is no closed loop with strong electric current, accordingly, there will not be damage to the lamp circuit apparatus. At this time, the high impedance capacitor C5 connected to the switch S1 in parallel has a high impedance on, for example, the mains voltage of 50 Hz, so that even if there is said closed loop, the electrical current produced is very weak.

What is claimed is:

1. A lamp circuit apparatus for safely connecting the lamp to the equipment voltage ground (EVG), comprising a rectification circuit (D1-D4) for rectifying a supplied power supply alternating voltage into a direct voltage, and an oscillating circuit (C3, L1, C4) for converting said direct voltage into alternating voltage for driving the lamp to work, wherein said oscillating circuit comprises the DC-blocking capacitor (C3), the oscillating inductor (L1) and the oscillating capacitor (C4) orderly connected in series, one end of said DC-blocking capacitor (C3) is connected to the output rectification voltage of said rectification circuit, and another end thereof is connected to said oscillating inductor (L1), while one end of said oscillating capacitor (C4) is connected to the equipment voltage ground (EVG), and another end thereof is connected to the working voltage terminal of the lamp, characterized in that the ground terminal of the lamp is electrically connected to the equipment voltage ground (EVG) through a parallel circuit formed of a switch (S1) and a high impedance capacitor (C5), wherein said switch (S1) is controlled by a control circuit provided within said apparatus to be closed only after the lamp is normally ignited, and to keep open under other states.

2. The apparatus according to claim 1, characterized in that the terminal of said oscillating capacitor (C4) which is connected to the equipment voltage ground (EVG) is electrically connected, together with the ground terminal of the lamp, to the equipment voltage ground (EVG) through said parallel circuit.

3. The apparatus according to claim 2, characterized in that a primary pre-heating coil (Ta) is connected between said oscillating capacitor (C4) and said high impedance capacitor (C5), and that two secondary pre-heating coils (Tb, Tc) are respectively connected to both terminals of the lamp, so that said secondary pre-heating coils (Tb, Tc) pre-heat the filament by using the voltage sensed from the primary pre-heating coil (Ta).

4. The apparatus according to claim 3, characterized in that the output voltage of said rectification circuit is connected to the input terminal of said DC-blocking capacitor (C3) through the first control switch (V2), then is connected to the equipment voltage ground (EVG) through the second control switch (V3), such that said oscillating circuit (C3, L1, C4) charges during work by means of the DC voltage through said first control switch (V2) and discharges towards the equipment voltage ground (EVG) through said second control switch (V3).

5. The apparatus according to claim 4, characterized in that said first and second control switch (V2, V3) are automatically controlled by said control circuit, so that said oscillating circuit oscillates according to the normal working current of the lamp.

6. The apparatus according to claim 5, characterized in that the output voltage of said rectification circuit (D1-D4) is smoothed by means of a downstream-connected filtering capacitor (C2).

7. The apparatus according to claim 1, characterized in that said DC-blocking capacitor (C3) is 100 times the capacitive value of said oscillating capacitor (C4).

8. The apparatus according to claim 1, characterized in that said rectification circuit (D1-D4) is formed of a half-bridge consisting of four diodes (D1-D4).

9. The apparatus according to claim 8, characterized in that the power supply voltage is connected to said half bridge through a de-interfering capacitor (C1) connected in parallel with said power supply voltage so as to filter interference voltage.

10. The apparatus according to claim 9, characterized in that a protective fuse (F) is connected between said de-interfering capacitor (C1) and the power supply.

11. The apparatus according to claim 10, characterized in that the power supply voltage is connected in parallel to another de-interfering capacitor (C6) between said protective fuse (F) and power supply.

* * * * *